US007002482B2

(12) United States Patent
Callaway

(10) Patent No.: US 7,002,482 B2
(45) Date of Patent: Feb. 21, 2006

(54) POSITION ACTIVATED MERCURY SWITCH

(76) Inventor: James J. Callaway, 615 Woodleigh Dr., Nashville, TN (US) 37215-1126

( * ) Notice: Subject to any disclaimer, the term of this patent is extended or adjusted under 35 U.S.C. 154(b) by 98 days.

(21) Appl. No.: 10/830,059

(22) Filed: Apr. 23, 2004

(65) Prior Publication Data

US 2004/0217875 A1 Nov. 4, 2004

Related U.S. Application Data

(60) Provisional application No. 60/466,433, filed on Apr. 30, 2003.

(51) Int. Cl.
*G08B 21/00* (2006.01)

(52) U.S. Cl. ..... 340/686.1; 340/689; 200/61.45 R; 200/61.52

(58) Field of Classification Search ..... 340/686.1, 340/689, 541, 429, 545.5, 566, 571, 506; 200/61.45 R, 61.52, 564, 61.83, 224, 226, 200/61.46

See application file for complete search history.

(56) References Cited

U.S. PATENT DOCUMENTS

| | | | | |
|---|---|---|---|---|
| 2,794,084 A * | 5/1957 | Segoni | ..... | 200/61.52 |
| 5,008,654 A | 4/1991 | Callaway | ..... | 340/573.7 |
| 5,146,206 A | 9/1992 | Callaway | ..... | 340/573.1 |
| 5,767,467 A * | 6/1998 | Grant | ..... | 200/61.52 |
| 6,087,936 A * | 7/2000 | Woods | ..... | 340/566 |
| 6,356,203 B1 * | 3/2002 | Halleck et al. | ..... | 340/689 |
| 6,853,301 B1 * | 2/2005 | Devine | ..... | 340/571 |

* cited by examiner

*Primary Examiner*—Anh V. La
(74) *Attorney, Agent, or Firm*—Jacobson Holman PLLC

(57) ABSTRACT

A mercury switch which is actuated only on a specific movement of an individual by design of an internal cavity of the switch to control movement of a mercury ball into and out of engagement with two electrical contacts. The internal cavity has a truncated cone for receipt of the mercury ball, a surface of revolution sloping outward from the opening of the truncated cone and an interruption ramp in this surface of revolution to guide the mercury ball into the truncated cone for actuation of a switch when a critical angle of the switch has been exceeded.

16 Claims, 2 Drawing Sheets

POSITION ACTIVATED MERCURY SWITCH

This application claims priority from and the benefit of U.S. Provisional Application Ser. No. 60/466,433, filed on Apr. 30, 2003, hereby incorporated by reference in its entirety.

BACKGROUND OF THE INVENTION

1. Field of the Invention

The present invention relates primarily to devices and methods for remote monitoring of bed-ridden patients to prevent injurious falls should the patient attempt to get out of bed. Devices of this type are seen in my prior U.S. Pat. Nos. 5,008,654 and 5,146,206, the subject matter of each of which is incorporated herein in its entirety by reference. However, the invention is generally related to any application where position and detection of a critical angle are required.

2. Discussion of the Related Art

The position activated mercury switch of this invention will be the primary component of the systems in my aforementioned patents. The system of the '206 patent presently employs three mercury switches precisely mounted within the "PATIENT AMBULATION MOTION DETECTOR WITH MULTIPLE SWITCH MOTION DETECTION" so that it is known when an undesirable and dangerous body position has been achieved. The present invention replaces the three mercury switches with a single self-contained unit thereby reducing the cost of the detection component and provides ease of assembly, and overall reliability.

A separate patent is applied for this device because it is anticipated that this switch will have independent application in manufacturing processes and as a component of additional consumer products. Initially, however, its application will be associated with the referenced device as a replacement for the three strategically positioned mercury switches thus offering the advantages previously listed.

SUMMARY OF THE INVENTION

Accordingly, it is an object of the present invention to provide a mercury switch which is actuated only on a specific movement of an individual by design of an internal cavity of the switch to control movement of a mercury ball into and out of engagement with two electrical contacts.

This object is realized by forming an internal cavity having a truncated cone for receipt of the mercury ball, a surface of revolution sloping outward from the opening of the truncated cone and an interruption ramp in this surface of revolution to guide the mercury ball into the truncated cone for actuation of a switch when a critical angle of the switch has been exceeded.

These and other objects of the invention, as well as many of the intended advantages thereof, will become more readily apparent when reference is made to the following description taken in conjunction with the accompanying drawings.

BRIEF DESCRIPTION OF THE DRAWINGS

The accompanying drawings are approximately four times the actual size of a switch configured for the referenced application. Other applications might require a larger or smaller size unit but the principles of operation would be the same and covered by this patent.

FIG. 5A shows the switch in the normal position (patient supine). The mercury ball is away from the contacts and the switch is "OFF". FIG. 5B shows the switch in the "OFF" position with the patient lying face down. FIG. 5C shows the switch "OFF" with the patient in position for eating, taking medications, or other activity while seated. FIG. 5D shows the switch in the "ON" position as a result of the patient leaning forward as would be necessary to transition to the standing position.

Like reference characters refer to like parts throughout the several views of the drawings.

DETAILED DESCRIPTION OF THE PREFERRED EMBODIMENTS

Figure 1:
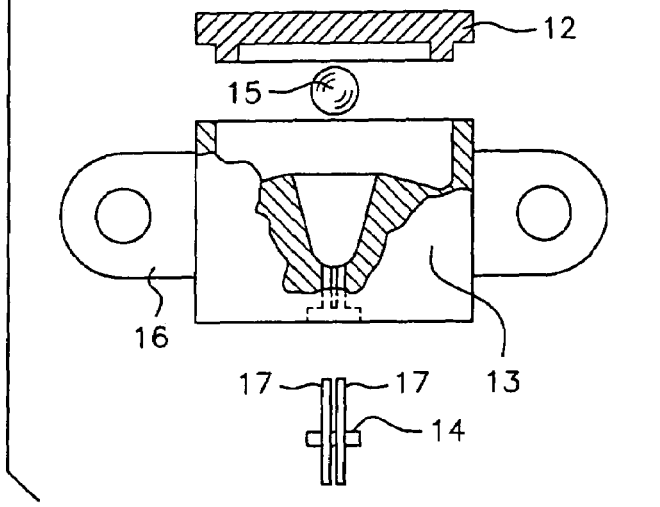
FIG. 1 is an exploded view of the component parts of the preferred Position Activated Mercury Switch of this invention.

In describing preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

Referring to FIG. 1, there is shown the components which make up the "Position Activated Mercury Switch" of this invention. The switch body 13 of the switch will be manufactured by injection molding both the internal and external configuration, the internal being the most important since its shape will determine the behavior of the mercury ball 15 as the switch body 13 is placed in an infinite number of positions. The mercury ball 15 is placed within the body and is free to move according to the dictates of gravity and the confinement of the internal configuration.

The size of the mercury ball will be determined by the switch size which, in turn, will be determined by the switch's application. When used to monitor a bed patient's position the switch would be about one fourth the size shown in the figures. The ball 15, therefore, would be approximately three millimeters in diameter. In any event, the ball will be sized so that the contact probes 17 will be immersed in the liquid mercury deep enough to assure adequate electrical contact.

The electrical conductor assembly 14 will be inserted into the switch body 13 through the passageways provided by the molding process so that contact with the mercury ball 15 will complete a simple electrical circuit and activate an applicable external event, for example, an alarm to warn that the patient is attempting ambulation.

A closure 12 is provided to assure that the mercury ball 15 remains within the internal cavity regardless of the switch's position. During assembly, the mercury ball 15 is placed within the internal cavity and the closure 12 sealed with an appropriate bonding material.

A mounting flange 16 is shown as an internal part of the molded switch body 13. Dependent on mounting requirements, the flange may be molded in any tangential plane to the body 13 of the switch. In certain applications, it may be desirable to eliminate the flange 16 altogether and mount the switch with an independent strap or clamp (not shown).

Figure 2:
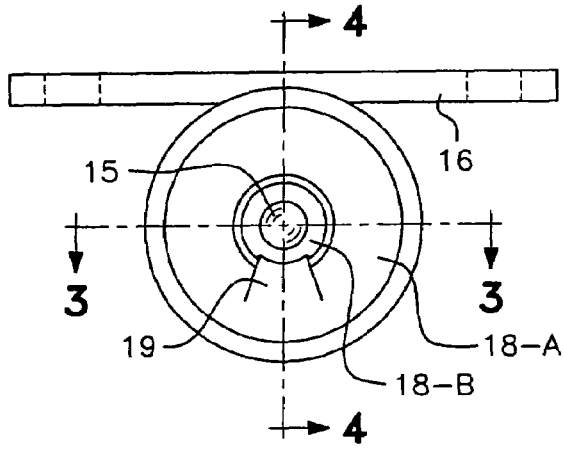
FIG. 2 is a plan view with the closure removed from the switch showing the injection molded internal configuration with the mercury ball in the "ON" position.

FIG. 2 is a plan view of the switch with the closure 12 removed so that the internal cavity can be viewed and its working surfaces can be explained. The internal cavity consists of three controlling surfaces: 18-B, a truncated cone which directs the mercury ball 15, shown in the "ON" position, to the electrical contacts (not visible); 18-A, a surface of revolution sloping outward from the opening of 18-B to control the position of the mercury ball 15 away from the electrical contact probes 17 when the switch position calls for the circuit to be broken, i.e., "OFF"; and 19, an interruption to the surface 18-A to provide a ramp to the conical surface 18-B. The ramp's purpose is to direct the mercury ball 15 to the cavity 18-B and the electrical contact probes 17. The ramp 19 is placed in the plane of motion to be monitored, in this case, the plane of the patient leaning forward in an attempt to stand from a seated position at bedside.

Figure 3:
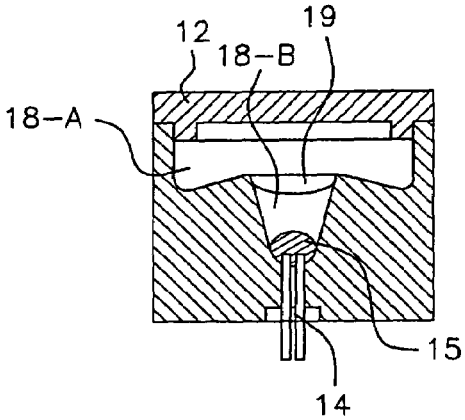
FIG. 3 is a vertical cross-sectional view of the switch taken along lines 3—3 of FIG. 2 with the mercury ball is in the "ON" position.

FIG. 3 is a section (3—3) through FIG. 2 and illustrates the shape of the internal cavity of the switch, the angle of slope of surface 18-A, and the directional ramp 19, into surface 18-B. All other components are presented, in place, as they would be after final assembly. The mercury switch is in the "ON" position.

Figure 4:
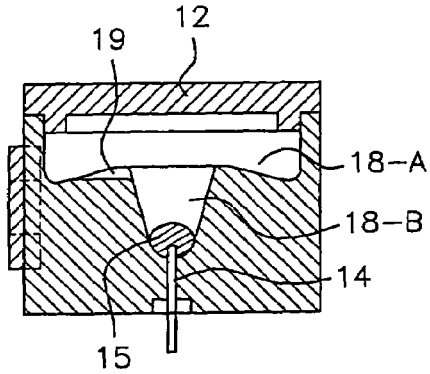
FIG. 4 is a cross-sectional view of the switch taken along lines 4—4 of FIG. 2 with the mercury ball in the "ON" position.

FIG. 4 is also a section (4—4) through FIG. 2. Here the difference in the directional ramp 19 and surface 18-A are more clearly shown. All other items are the same.

FIG. 5 shows the four primary positions the switch will monitor. The combination of these positions are limitless. The location of the mercury ball 15 under the influence of gravity deals with these positions and only turns the switch "ON" when tilted forward as shown in 5D. In all Figures, the double-lined side of the switch body is the side attached to the patient.

Figure 5A:
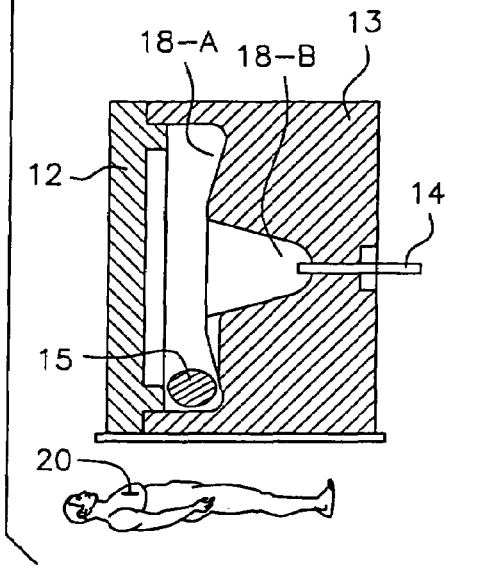
FIGS. 5A–5D are views similar to FIG. 4 with the mercury ball in various positions obtained when used in a system such as discussed in my earlier patents. Four basic positions are shown.

FIG. 5A shows the patient (human figure) supine with the switch mounted on his/her upper body as indicated by the short line 20 in the chest area. The switch would be as shown; mercury ball 15 in the upper chamber and in the "OFF" condition. This would be the normal position for a bed-ridden patient.

Figure 5B:
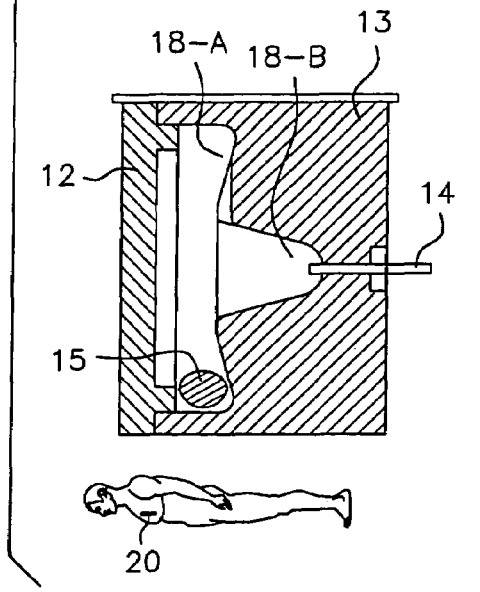

FIG. 5B indicates the switch condition if the patient is face-down or in any combination of FIG. 5A and FIG. 5B.

Figure 5C:
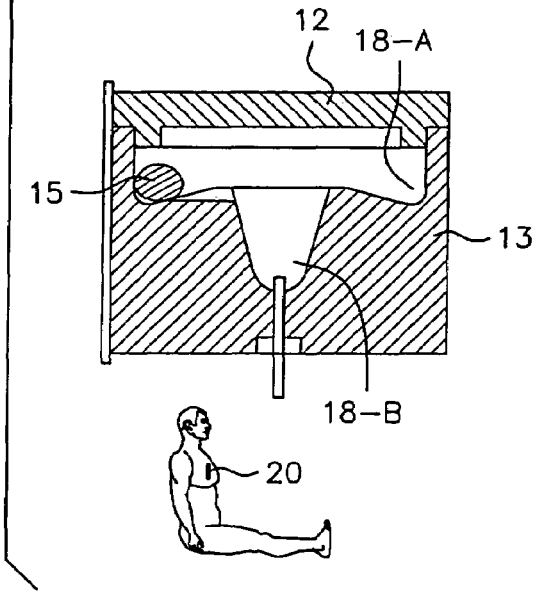

FIG. 5C shows the patient sitting up. The switch is still in the "OFF" condition, but the mercury ball 15 is in the "ready" position. Should the patient lean forward to the switch's critical angle, the alarm would be activated. The sitting position is important in that the patient must eat, take medicine, etc. Sensitivity to the allowable forward motion and avoidance of false alarms can be built into the system by proper design and angle of the directional ramp 19.

Figure 5D:
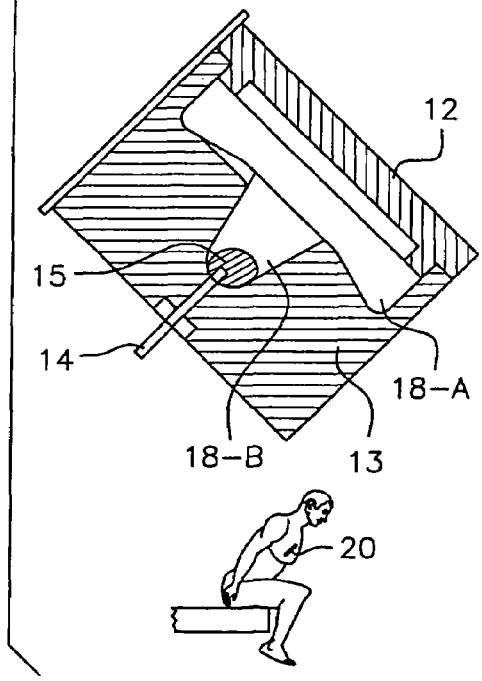

FIG. 5D shows the mercury switch in the "ON" (alarm) position. The critical angle has been exceeded. The mercury ball 15 has fallen into the cavity containing the electrical conductor assembly 14 and the alarm has been sounded. To turn the switch off, the switch (and patient) should be returned to the position of FIG. 5A or 5B. The mercury ball 15 will then move out of contact with the electrical elements and the circuit will be broken.

The foregoing description should be considered as illustrative only of the principles of the invention. Since numerous modifications and changes will readily occur to those skilled in the art, it is not desired to limit the invention to the exact construction and operation shown and described, and, accordingly, all suitable modifications and equivalents may be resorted to, falling within the scope of the invention.

I claim:

1. A position activated switch comprising:

a switch body, and an internal cavity of the switch body including a truncated conical surface terminating at an open end in a surface of revolution, the surface of revolution sloping outwardly from the open end of the truncated conical surface, and a ramp surface interrupting the surface of revolution, the ramp surface extending into the truncated conical surface.

2. The position activated switch as claimed in claim 1, wherein a mercury ball is located in the internal cavity.

3. The position activated switch as claimed in claim 2, wherein two electrical contact probes are located at a closed end of the truncated conical surface.

4. The position activated switch as claimed in claim 3, wherein contact of the mercury ball with the two electrical contact probes completes an electrical circuit.

5. The position activated switch as claimed in claim 3, wherein said mercury ball moves from the surface of revolution into the truncated conical surface via the ramp surface when the switch body is titled.

6. The position activated switch as claimed in claim 1, wherein the internal cavity is sealed by a closure cap.

7. The position activated switch as claimed in claim 3, wherein the two electrical contact probes extend partially into the switch body and extend partially out of the switch body.

8. A patent ambulation motion detector comprising:

a switch body, an internal cavity of the switch body including a truncated conical surface terminating at an open end in a surface of revolution, the surface of revolution sloping outwardly from the open end of the truncated conical surface, and a ramp surface interrupting the surface of revolution, the ramp surface extending into the truncated conical surface, a mounting flange for supporting the switch body.

9. The patent ambulation motion detector as claimed in claim 8, wherein a mercury ball is located in the internal cavity.

10. The patent ambulation motion detector as claimed in claim 9, wherein two electrical contact probes are located at a closed end of the truncated conical surface.

11. The patent ambulation motion detector as claimed in claim 10, wherein contact of the mercury ball with the two electrical contact probes completes an electrical circuit.

12. The patent ambulation motion detector as claimed in claim 10, wherein said mercury ball moves from the surface of revolution into the truncated conical surface via the ramp surface when the switch body is titled.

13. The patent ambulation motion detector as claimed in claim 8, wherein the internal cavity is sealed by a closure cap.

14. The patent ambulation motion detector as claimed in claim 10, wherein the two electrical contact probes extend partially into the switch body and extend partially out of the switch body.

15. The patent ambulation motion detector as claimed in claim 9, wherein the mercury ball has a diameter of 3 mm.

16. The patent ambulation motion detector 8, wherein the mounting flange has two mounting openings.

* * * * *